US010370129B2

(12) United States Patent
Steed et al.

(10) Patent No.: US 10,370,129 B2
(45) Date of Patent: Aug. 6, 2019

(54) ASSEMBLIES INCLUDING PLUG DEVICES, AND RELATED PLUG DEVICES AND METHODS

(71) Applicant: Dash LLC, West Valley City, UT (US)

(72) Inventors: Daniel J. Steed, West Valley City, UT (US); Shiloh D. Poulsen, Magna, UT (US)

(73) Assignee: Dash LLC, West Valley City, UT (US)

( * ) Notice: Subject to any disclaimer, the term of this patent is extended or adjusted under 35 U.S.C. 154(b) by 649 days.

(21) Appl. No.: 14/827,936

(22) Filed: Aug. 17, 2015

(65) Prior Publication Data

US 2017/0050769 A1 Feb. 23, 2017

(51) Int. Cl.

| | |
|---|---|
| ***B65B 7/28*** | (2006.01) |
| ***B02C 17/04*** | (2006.01) |
| ***B02C 17/18*** | (2006.01) |
| ***B02C 17/22*** | (2006.01) |

(52) U.S. Cl.

CPC ..... *B65B 7/2821* (2013.01); *B02C 17/04* (2013.01); *B02C 17/18* (2013.01); *B02C 17/22* (2013.01)

(58) Field of Classification Search

CPC ..... B65B 7/2821; B02C 17/02; B02C 17/00
See application file for complete search history.

(56) References Cited

U.S. PATENT DOCUMENTS 4,141,511 A * 2/1979 Anderson ..... B02C 17/225 241/183
4,289,279 A * 9/1981 Brandt ..... B02C 17/225 241/102
4,371,120 A * 2/1983 Grapin ..... B02C 17/22 241/182
5,735,377 A * 4/1998 Herren ..... B65D 90/043 193/33
7,172,144 B1 * 2/2007 Slater ..... B02C 17/1805 241/101.2
2002/0025840 A1 2/2002 Beck (Continued)

FOREIGN PATENT DOCUMENTS

| | | |
|---|---|---|
| DE | 10314862 A1 | 10/2004 |
| EP | 0195614 A2 | 9/1986 |
| WO | 2016/086326 A1 | 6/2016 |

OTHER PUBLICATIONS

International Search Report from International PCT Application No. PCT/US2016/047182, dated Jan. 6, 2017, 3 pages.

(Continued)

*Primary Examiner* — Jeffrey R Allen

(74) *Attorney, Agent, or Firm* — TraskBritt

(57) ABSTRACT

An assembly comprises a vessel comprising a shell exhibiting at least one opening extending therethrough, a structure covering an internal surface of the shell, and at least one plug device contacting the shell and the structure. The at least one plug device comprises a rigid body comprising a male connection structure longitudinally extending into the least one opening, and a base structure extending outwardly beyond a lateral periphery of the male connection structure and positioned longitudinally between the structure and the shell. A plug device for a milling application, and a method of plugging a component of an assembly are also described.

17 Claims, 3 Drawing Sheets

123

(56) References Cited

U.S. PATENT DOCUMENTS

| | | | | |
|---|---|---|---|---|
| 2003/0062761 | A1* | 4/2003 | Gorges | B60B 3/16 301/35.629 |
| 2004/0113004 | A1 | 6/2004 | Schneider | |
| 2006/0118665 | A1 | 6/2006 | Heidel | |
| 2006/0131453 | A1* | 6/2006 | Barscevicius | B02C 1/025 241/36 |
| 2007/0088442 | A1* | 4/2007 | Cima | A61B 5/055 623/18.11 |
| 2011/0037983 | A1* | 2/2011 | Davies | G01M 11/08 356/445 |

OTHER PUBLICATIONS

International Written Opinion from International PCT Application No. PCT/US2016/047182, dated Jan. 6, 2017, 6 pages.
Australian Examination Report from Australian Application No. 2016308629, dated Jan. 14, 2019, 4 pages.
Canadian Office Action from Canadian Application No. 2,994,556, dated Jan. 21, 2019, 4 pages.

* cited by examiner

ASSEMBLIES INCLUDING PLUG DEVICES, AND RELATED PLUG DEVICES AND METHODS

TECHNICAL FIELD

The disclosure, in various embodiments, relates generally to assemblies, devices, and methods for use in processing a mined material, such as ore. More particularly, embodiments of the disclosure relate to assemblies including plug devices, to plug devices, and to methods of plugging a component of an assembly.

BACKGROUND

The mining industry frequently utilizes mills (e.g., rotary mills, ball mills, rod mills, semiautogenous mills, autogenous mills, etc.) to reduce the size of masses of material structures (e.g., ore) mined from the earthen formations. During use and operation of a mill, mined structures (and, optionally, other structures, such as balls, rods, etc.) are typically lifted and dropped back onto other mined structures to form relatively smaller structures through the resulting impacts. The process can be continuous, with relatively large mined material structures being delivered into one end of the mill and relatively smaller material structures (e.g., particles) of the mined material exiting an opposite end of the mill.

Generally, internal surfaces of a mill are covered (e.g., lined) with wear-resistant structures (e.g., liners, plates, etc.) sized and shaped to prevent damage to the mill resulting from contact between the mined material structures (and, optionally, other structures) and the internal surfaces of the mill during use and operation of the mill. The mined material structures contact and degrade (e.g., wear, abrade, etc.) the wear-resistant structures rather than the internal surfaces of the mill. The wear-resistant structures may be attached to the internal surfaces of the mill by way of retaining structures (e.g., retaining bolts), and may be detached and replaced upon exhibiting significant wear. Thus, the wear-resistant structures can prolong the durability and use of the mill.

A mill is typically configured to accommodate a variety of wear-resistant structure configurations (e.g., shapes, sizes, retaining structure hole distributions, retaining structure hole sizes, retaining structure hole shapes, etc.). For example, a shell of a conventional mill can include a variety of openings (e.g., holes, apertures, vias, etc.) independently configured (e.g., sized and shaped) and positioned to accommodate different shapes, sizes, and distributions of wear-resistant structures and retaining bolts. Depending on the configurations and positions of the wear-resistant structures and the retaining structures, some of the holes may be filled with the retaining structures while other of the holes may be free of (e.g., unfilled by) the retaining structures. Deformable plug structures (e.g., cork plugs, rubber plugs, etc.) may be provided within the holes free of the retaining bolts to prevent materials (e.g., corrosive fluids) within the mill from escaping during use and operation of the mill. Such deformable plug structures are generally wedged into upper portions of the holes (e.g., portions of the holes proximate external surfaces of the mill opposite internal surfaces of the mill), and are retained therein until the wear-resistant structures require replacement.

Unfortunately, the configurations and positions of conventional deformable plug structures can create problems for milling operations. For example, conventional deformable plug structures can be difficult to extract (e.g., pry, pull, etc.) from the holes in the mill shell, requiring excessive amounts of time and labor. Such excessive amounts of time and labor can reduce the efficiency and throughput of milling operations by undesirably prolonging wear-resistant structure replacement operations. In addition, conventional deformable plug structures may be nearly impossible to remove without sustaining significant damage thereto, preventing reuse of conventional deformable plug structures for subsequent milling operations. Furthermore, the materials (e.g., cork, rubber, etc.) of conventional deformable plug structures can degrade (e.g., deteriorate, decompose, break down, etc.) under the environmental conditions (e.g., temperatures; pressures; materials, such as solvents, corrosive liquids, lubricants, small particles, etc.; rotational speeds; etc.) present in conventional milling operations, which can decrease process safety and/or result in one or more of equipment damage and undesirable maintenance downtime.

It would, therefore, be desirable to have new assemblies, plug devices, and methods for milling operations that reduce, if not eliminate, at least some of the aforementioned problems.

BRIEF SUMMARY

Embodiments described herein include assemblies including plug devices, plug devices, and methods of plugging a component of an assembly. For example, in accordance with one embodiment described herein, an assembly comprises a vessel comprising a shell exhibiting at least one opening extending therethrough, a structure covering an internal surface of the shell, and at least one plug device contacting the shell and the structure. The at least one plug device comprises a rigid body comprising a male connection structure longitudinally extending into the least one opening in the shell, and a base structure extending outwardly beyond a lateral periphery of the male connection structure and positioned longitudinally between the structure and the shell.

In additional embodiments, a plug device for a milling application comprises a rigid body comprising a base structure, and a male connection structure longitudinally protruding from the base structure. The base structure extends outwardly beyond a lateral periphery of the male connection structure.

In yet additional embodiments, a method of plugging a component of an assembly comprises delivering a plug device into an opening extending through a shell of a vessel. The plug device comprises a rigid body comprising a male connection structure extending partially through the opening from an internal surface of the shell, and a base structure longitudinally adjacent the internal surface of the shell and extending outwardly beyond a lateral periphery of the male connection structure. The internal surface of the shell with is covered with a structure, an external surface of the structure physically contacting at least one surface of the plug device. The structure is coupled to the shell using at least one retention device extending through the structure and the shell.

DETAILED DESCRIPTION

Figure 1:
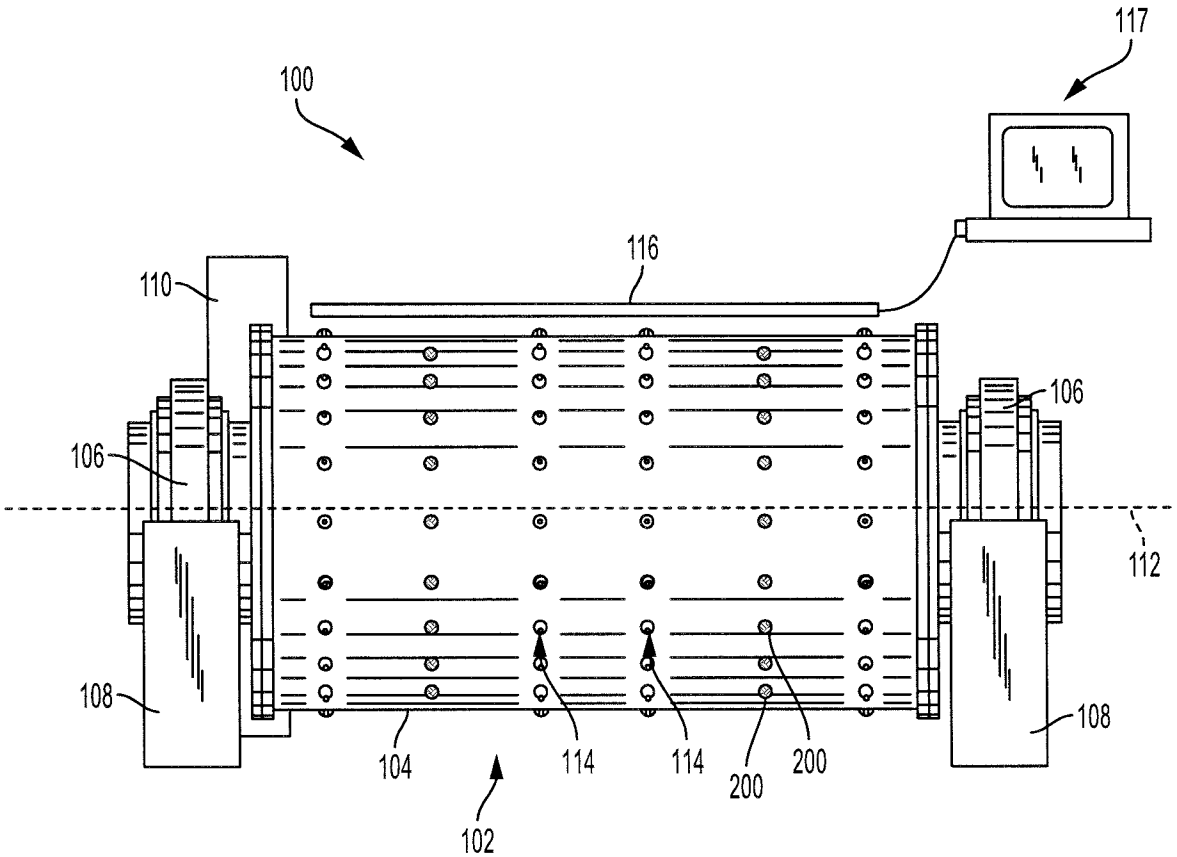
FIG. 1 is a longitudinal schematic view of an assembly, in accordance with an embodiment of the disclosure.

Assemblies including plug devices are disclosed, as are plug devices, and methods of plugging a component of an assembly. In some embodiments, an assembly includes a vessel (e.g., mill) comprising a shell exhibiting at least one opening extending therethrough, at least one structure (e.g., at least one wear-resistant structure) covering an internal surface of the shell, and at least one plug device within the at least one opening and contacting the internal surface of the shell and at least one external surface of the at least one structure. The plug device includes a rigid body having a male connection structure longitudinally extending into the least one opening in the shell of the vessel, and a base structure extending outwardly beyond a lateral periphery of the male connection structure and positioned longitudinally between the structure and the shell of the vessel. Optionally, the plug device may also include one or more of a deformable structure (e.g., a flexible structure, such as a flexible seal) on the base structure and surrounding the male connection structure, an aperture extending at least partially through the rigid body, and one or more devices (e.g., a position adjustment device, a sensor, etc.) and/or structures within the aperture. The assemblies, plug devices, and methods of the disclosure may provide enhanced efficiency, reduced costs, and increased safety relative to conventional assemblies, plug devices, and methods associated with milling operations.

The following description provides specific details, such as material types, shapes, sizes, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure, device, or assembly. The structures described below do not necessarily form a complete device or a complete assembly. Only those process acts and structures necessary to understand the embodiments of the disclosure are described in detail below. Additional acts to form a complete device or a complete assembly from various structures described herein may be performed by conventional fabrication processes.

Drawings presented herein are for illustrative purposes only, and are not meant to be actual views of any particular material, component, structure, device, or assembly. Variations from the shapes depicted in the drawings as a result, for example, of manufacturing processes and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the claims. The drawings are not necessarily to scale. Additionally, elements common between figures may retain the same numerical designation.

Although some embodiments of the disclosure are depicted as being used and employed in particular assemblies and components thereof, persons of ordinary skill in the art will understand that the embodiments of the disclosure may be employed in any assembly and/or component thereof where it is desirable to enhance wear detection (e.g., sensing, indication, etc.) relating to the assembly and/or component thereof during use and operation. By way of non-limiting example, embodiments of the disclosure may be employed in any equipment associated with processing a mined material (e.g., ore) and subject to degradation (e.g., physical degradation and/or chemical degradation) including, but not limited to, rotary mills, ball mills, rod mills, semiautogenous (SAG) mills, autogenous (AG) mills, crushers, impactors, grinders, hoppers, bins, chutes, and other components associated with processing (e.g., grinding, crushing, pulverizing, etc.) a mined material, as known in the art.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "and" and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the term "configured" refers to a size, shape, material composition, and arrangement of one or more of at least one structure and at least one apparatus facilitating operation of one or more of the at least one structure and the at least one apparatus in a pre-determined way.

FIG. 1 is a longitudinal schematic view of an assembly 100 for use in accordance with an embodiment of the disclosure. The assembly 100 may be configured and operated to break down (e.g., grind, crush, pulverize, etc.) a mined material, such as ore. As shown in FIG. 1, the assembly 100 may include a vessel 102 (e.g., grinder, mill, etc.) formed of and including a shell 104. Bearings 106 and support structures 108 may be located at opposing lateral ends of the vessel 102, and at least one rotation device 110 (motor, drive, etc.) may be positioned and configured to rotate the vessel 102 about an axis 112 thereof. Retention devices 114 (e.g., bolts) extend into an internal chamber of the vessel 102, and are positioned and configured to attach (e.g., couple, bond, adhere, etc.) wear-resistant structures within the vessel 102 to at least one internal surface of the shell 104. In some embodiments, one or more of the retention devices 114 may also be configured and positioned to obtain and communicate information (e.g., wear information, acceleration information, acoustic information, etc.) related to the use and operation of the vessel 102. By way of non-limiting example, at least one of the retention devices 114 may comprise a wear indication device, such as one or more of the wear indication devices described in U.S. patent application Ser. Nos. 14/304,649 and 14/791,081, the disclosure of each of which is hereby incorporated herein in its entirety by this reference. In addition, as described in further detail below, the assembly 100 includes plug devices 200 at least partially disposed between the wear-resistant structures within the vessel 102 and the internal surface of the shell 104, and partially extending into holes in the shell 104 from the internal surface of the shell 104. The assembly 100 may also include at least one receiving device 116 positioned and configured to receive information (e.g., data) from one or more of the retention devices 114 and/or one or more the plug devices 200, and to communicate the information to one or more other devices 117 (e.g., computers) configured and operated to analyze, display, store, and/or act upon the information.

While FIG. 1 depicts a particular configuration of the assembly 100, one of ordinary skill in the art will appreciate that the assembly 100 may exhibit a different configuration, such as a configuration exhibiting one or more of a different size, a different shape, different features, different feature spacing, different components, and a different arrangement of components. FIG. 1 illustrates just one non-limiting example of the assembly 100. By way of non-limiting example, the assembly 100 may, alternatively, include a different number and/or a different arrangement of the plug devices 200 and/or the retention devices 114.

Figure 2:
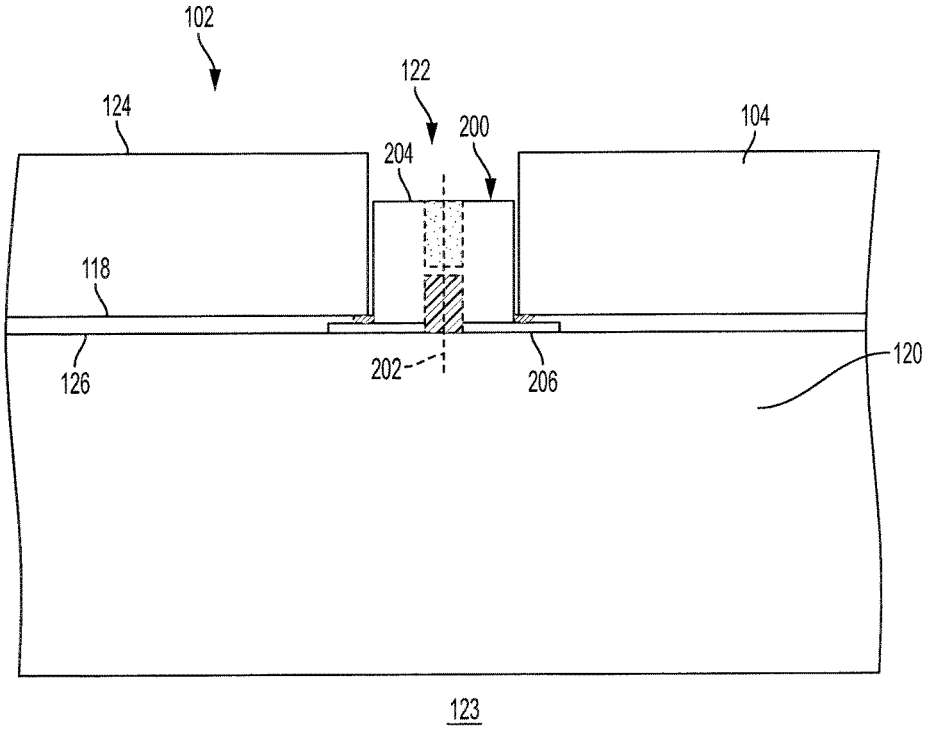
FIG. 2 is a partial, transverse cross-sectional view of a portion of the assembly depicted in FIG. 1, in accordance with an embodiment of the disclosure.

FIG. 2 is a partial, transverse cross-sectional view of the vessel 102 depicted in FIG. 1 at a location proximate one of the plug devices 200. As shown in FIG. 2, at least one internal surface 118 of the shell 104 of the vessel 102 is covered (e.g., lined) with at least one wear-resistant structure 120 (e.g., a wear plate, a wear liner, etc.). The wear-resistant structure 120 may be formed of and include at least one material that is resistant to physical degradation (e.g., abrasion, erosion, etc.) and/or chemical degradation (e.g., corrosion). The wear-resistant structure 120 may have any geometric configuration (e.g., shape and size) sufficient to substantially protect the shell 104 of the vessel 102 from degradation. In some embodiments, the internal surface 118 of the shell 104 is covered with a plurality of wear-resistant structures 120 positioned adjacent (e.g., laterally adjacent and/or longitudinally adjacent) to one another within an internal chamber 123 of the vessel 102, each of the plurality of wear-resistant structures 120 independently exhibiting a desired shape, size, and material composition.

Referring collectively to FIGS. 1 and 2, the plug devices 200 may be configured and positioned to plug (e.g., seal, cap, etc.) openings 122 (e.g., apertures, holes, vias, etc.) in the shell 104 of the vessel 102, and to remain in place during use and operation of the vessel 102. Portions of the plug devices 200 may longitudinally extend into the openings 122 in the shell 104, and additional portions of the plug devices 200 may be disposed longitudinally between the wear-resistant structure 120 and the shell 104. As used herein with respect to one or more of the plug devices 200, each of the terms "lateral" and "horizontal" means and includes extending in a direction substantially perpendicular (e.g., orthogonal) to a central axis 202 of the plug device 200, regardless of the orientation of the plug device 200. Accordingly, as used herein with respect to one or more of the plug devices 200, each of the terms "longitudinal" and "vertical" means and includes extending in a direction substantially parallel to the central axis 202 of the plug device 200, regardless of the orientation of the plug device 200. For example, as depicted in FIG. 2, portions of the plug devices 200 may be positioned within and may substantially fill portions of the openings 122 proximate the internal surface 118 of the shell 104, and additional portions of the plug devices 200 may be positioned between the internal surface 118 of the shell 104 and an external surface 126 of the wear-resistant structure 120. Each of the plug devices 200 may be held (e.g., retained, maintained, etc.) in a desired longitudinal position and a desired lateral position by the shell 104 and wear-resistant structure 120.

As shown in FIG. 2, an upper surface 204 of one or more of the plug devices 200 may be recessed relative to an external surface 124 of the shell 104. Recessing the upper surface 204 of the plug device 200 may assist in subsequent removal of the plug device 200 and/or the wear-resistant structure 120 (e.g., during maintenance and/or replacement operations). For example, recessing the upper surface 204 of the plug device 200 relative the external surface 124 of the shell 104 may permit at least a portion (e.g., a pillar, a shaft, a rod, etc.) of a removal tool (e.g., a hammer tool) to be provided into and positioned within upper portions of the opening 122 (e.g., a portion of the opening 122 proximate the external surface 124 of the shell 104) to selectively apply force (e.g., downward force) to the plug device 200 (e.g., to the upper surface 204 of the plug device 200) to assist in the removal of the plug device 200 from the opening 122 and/or in the detachment of the wear-resistant structure 120 from the shell 104. In additional embodiments, the upper surface 204 of one or more of the plug devices 200 may not be recessed relative to the external surface 124 of the shell 104. For example, the upper surface 204 of the plug device 200 may be substantially coplanar with and/or may protrude longitudinally outward beyond the external surface 124 of the shell 104. In addition, as shown in FIG. 2, a lower surface 206 of one or more of the plug devices 200 (e.g., a surface opposite the upper surface 204) may be positioned on or over an external surface 126 of the wear-resistant structure 120 (e.g., a surface of the wear-resistant structure 120 proximate the internal surface 118 of the shell 104). For example, at least a portion of the lower surface 206 of the plug device 200 may be substantially coplanar with the external surface 126 of the wear-resistant structure 120.

Figure 3:
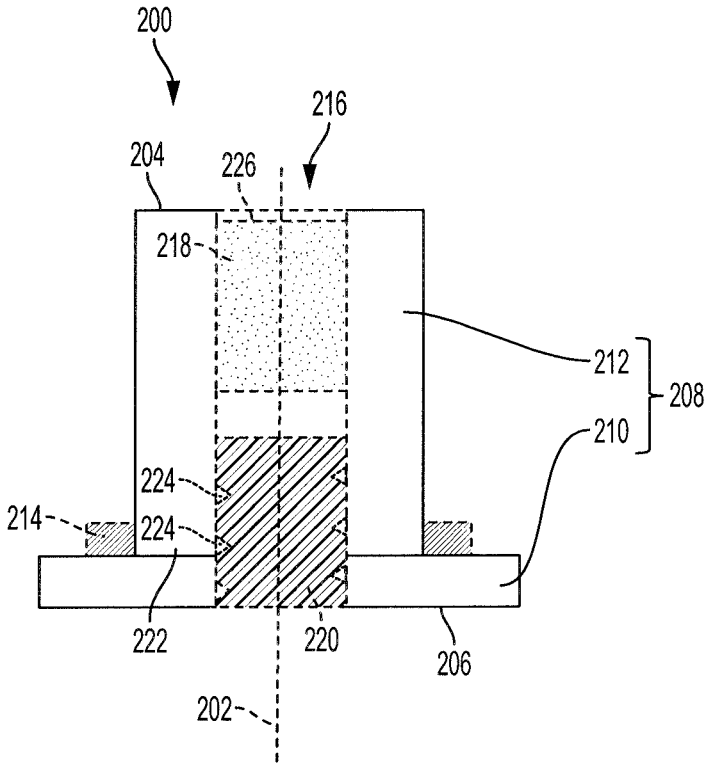
FIG. 3 is a transverse cross-sectional view of a plug device, in accordance with an embodiment of the disclosure.

FIG. 3 is a partial cross-sectional view of the plug device 200 depicted in FIG. 2. As shown in FIG. 3, the plug device 200 includes a rigid body 208 including a base structure 210 and a male connection structure 212 longitudinally projecting (e.g., extending, protruding, etc.) from the base structure 210. The base structure 210 may extend laterally outward beyond a periphery of the male connection structure 212. Optionally, the plug device 200 may also include one or more of at least one deformable structure 214 (e.g., at least one flexible structure, such as at least one flexible seal) at least partially (e.g., substantially) surrounding one or more portions of the rigid body 208, and at least one aperture 216 (e.g., opening, hole, via, bore, recess, etc.) extending at least partially (e.g., completely) through the rigid body 208. If the plug device 200 includes the aperture 216, the plug device 200 may also include one or more devices and/or structures at least partially disposed within the aperture 216. For example, as depicted in FIG. 3, the plug device 200 may, optionally, include one or more of a sensor 218 and an adjustment device 220 (e.g., a position adjustment device) at least partially contained (e.g., held) within the aperture 216. In some embodiments, the plug device 200 includes each of the rigid body 208, the aperture 216, the deformable structure 214, the sensor 218, and the adjustment device 220. In additional embodiments, the plug device 200 includes the rigid body 208, but does not include at least one of the deformable structure 214, the aperture 216, the sensor 218, and the adjustment device 220 (e.g., includes the rigid body 208, but does not include the deformable structure 214, the aperture 216, the sensor 218, and the adjustment device 220; includes the rigid body 208 and the deformable structure 214, but does not include one or more of the aperture 216, the sensor 218, and the adjustment device 220; includes the rigid body 208, the deformable structure 214, the aperture 216, and the adjustment device 220, but does not include the sensor 218; includes the rigid body 208, the deformable structure 214, the aperture 216, and the sensor 218, but does not include the adjustment device 220; etc.). While FIG. 3 depicts a particular configuration of the plug device 200, one of ordinary skill in the art will appreciate that different plug device configurations are known in the art which may be adapted to be employed in embodiments of the disclosure. FIG. 3 illustrates just one non-limiting example of the plug device 200.

The rigid body 208 of the plug device 200 may exhibit a shape and a size that complements a shape and a size of the opening 122 (FIG. 2) to receive the plug device 200, and that permits the plug device 200 to be retained within the opening 122 and between the wear-resistant structure 120 (FIG. 2) and the shell 104 (FIG. 2) of the vessel 102 (FIG. 2). For example, the male connection structure 212 of the rigid body 208 may exhibit a shape (e.g., a cylindrical column shape, a dome shape, a cone shape, a frusto cone shape, a tube shape, rectangular column shape, a fin shape, a pillar shape, a stud shape, a pyramid shape, a frusto pyramid shape, an irregular shape, etc.) complementary to a shape of the opening 122, a width (e.g., diameter) less than or equal to (e.g., slightly smaller than) a width of the opening 122, and a height less than or equal to (e.g., less than) a thickness of the shell 104. In addition, the base structure 210 of the rigid body 208 may exhibit a shape (e.g., a cylindrical column shape, a dome shape, a cone shape, a frusto cone shape, a tube shape, rectangular column shape, a fin shape, a pillar shape, a stud shape, a pyramid shape, a frusto pyramid shape, an irregular shape, etc.) allowing the base structure 210 to contact surfaces (e.g., the internal surface 118 shown in FIG. 2) of the shell 104 outside of the opening 122 and surfaces (e.g., the external surface 126 shown in FIG. 2) of the wear-resistant structure 120 proximate the shell 104, a width (e.g., diameter) greater than the width of the opening 122 (and, hence, greater than the width of the male connection structure 212), and any height providing the base structure 210 with suitable structural integrity. In some embodiments, the male connection structure 212 exhibits a cylindrical column shape, and the base structure 210 exhibits a relatively wider cylindrical column shape than the male connection structure 212.

The male connection structure 212 may be coupled (e.g., attached, bonded, adhered, etc.) to the base structure 210. For example, as shown in FIG. 3, a lower surface of the male connection structure 212 may be coupled to an upper surface of the base structure 210 at an interface 222. The male connection structure 212 may be coupled to the base structure 210 using one or more conventional processes (e.g., a conventional welding process, a conventional brazing process, a conventional soldering process, an conventional adhesion process, etc.), and conventional processing equipment, which are not described in detail herein. In some embodiments, the male connection structure 212 is welded to the base structure 210 (e.g., the male connection structure 212 is coupled to the base structure 210 through a weld joint). In additional embodiments, the male connection structure 212 and the base structure 210 are integral and continuous with one another, such that the rigid body 208 comprises a substantially monolithic structure. In such embodiments, the rigid body 208 may be formed using one or more conventional processes (e.g., a conventional injection molding process, a conventional sintering process, etc.) and conventional processing equipment, which are also not described in detail herein.

The rigid body 208, including the base structure 210 and the male connection structure 212 thereof, may be formed of and include at least one rigid material, such as a rigid material suitable for use in a milling environment. By way of non-limiting example, the rigid body 208 may be formed of and include one or more of a metal (e.g., tungsten, titanium, molybdenum, niobium, vanadium, hafnium, tantalum, chromium, zirconium, iron, ruthenium, osmium, cobalt, rhodium, iridium, nickel, palladium, platinum, copper, silver, gold, aluminum, etc.), a metal alloy (e.g., a cobalt-based alloy, an iron-based alloy, a nickel-based alloy, an iron- and nickel-based alloy, a cobalt- and nickel-based alloy, an iron- and cobalt-based alloy, a cobalt- and nickel- and iron-based alloy, an aluminum-based alloy, a copper-based alloy, a magnesium-based alloy, a titanium-based alloy, a steel, a low-carbon steel, a stainless steel, etc.), a metal-containing material (e.g., a metal nitride, a metal silicide, a metal carbide, a metal oxide), a ceramic material (e.g., carbides, nitrides, oxides, and/or borides, such as carbides and borides of at least one of tungsten, titanium, molybdenum, niobium, vanadium, hafnium, tantalum, chromium, zirconium, aluminum, and silicon), and a ceramic-metal composite material. In some embodiments, the rigid body 208 is formed of and includes a metal alloy (e.g., a steel alloy).

The rigid body 208 may include a substantially homogeneous distribution or a substantially heterogeneous distribution of the at least one rigid material. As used herein, the term "homogeneous distribution" means amounts of a material do not vary throughout different portions (e.g., different lateral portions and different longitudinal portions) of a structure. Conversely, as used herein, the term "heterogeneous distribution" means amounts of a material vary throughout different portions of a structure. Amounts of the material may vary stepwise (e.g., change abruptly), or may vary continuously (e.g., change progressively, such as linearly, parabolically, etc.) throughout different portions of the structure. In some embodiments, the rigid body 208 exhibits a substantially homogeneous distribution of rigid material. In additional embodiments, the rigid body 208 exhibits a substantially heterogeneous distribution of at least one rigid material. By way of non-limiting example, the base structure 210 may be formed of and include a different rigid material than the male connection structure 212.

With continued reference to FIG. 3, if present, the deformable structure 214 (e.g., flexible seal) may be configured and positioned relative to the rigid body 208 to substantially completely seal the opening 122 (FIG. 2) within which the plug device 200 is positioned. The deformable structure 214 may, for example, be configured and positioned to seal against the base structure 210 of the rigid body 208 and the shell 104 (FIG. 2) of the vessel 102 (FIG. 2) to prevent one or more materials (e.g., fluids, solid particles, etc.) from exiting from the vessel 102 through the opening 122. The configuration and position of the deformable structure 214 may account for differences between the width (e.g., diameter) of the male connection structure 212 of the rigid body 208 and the width of the opening 122 to receive the male connection structure 212 so as to substantially limit or even prevent material from flowing through the opening 122 (e.g., through space between a sidewall of the male connection structure 212 and a sidewall of the opening 122) during use and operation of the vessel 102. By way of non-limiting example, the deformable structure 214 may comprise an annular (e.g., ring-shaped) structure sized and positioned to surround a lateral periphery of the male connection structure 212. The deformable structure 214 may be positioned on or over the base structure 210 (e.g., on or over an upper surface of the base structure 210) and laterally adjacent the male connection structure 212 (e.g., directly laterally adjacent and in contact with each sidewall of the male connection structure 212). The deformable structure 214 may be tapered such that one end (e.g., an end proximate the base structure 210 of the rigid body 208) of the deformable structure 214 has a relatively larger width and/or a relatively larger area than another end (e.g., an end distal from the base structure 210 of the rigid body 208) of the deformable structure 214, or may be substantially non-tapered. If desired, a tapered configuration of the deformable structure 214 may, for example, permit a portion (e.g., a portion distal from the base structure 210 of the rigid body 208) of the deformable structure 214 to longitudinally extend into the opening 122 to receive the plug device 200.

If present, the deformable structure 214 may be formed of and include at least one deformable material, such as a deformable material suitable for use in a milling environment. By way of non-limiting example, deformable structure 214 may be formed of and include a solid polymeric material (e.g., a solid elastomeric material) exhibiting rubbery elastic extensibility and restoring properties. The solid polymeric material may exhibit properties (e.g., elastic modulus, bulk modulus, shear modulus, thermal resistance, tensile strength, hardness, abrasion resistance, chemical resistance, extrusion resistance, elongation, etc.) favorable to the use of the deformable structure 214 (and, hence, the plug device 200) in hostile environmental conditions (e.g., high temperatures, high pressures, corrosive conditions, abrasive conditions, etc.), such as the environmental conditions present in various milling applications. In some embodiments, the deformable structure 214 is formed of and includes a solid rubber material (e.g., silicone rubber, butyl rubber, polyurethane rubber, ethylene propylene diene monomer rubber, polyisoprene rubber, natural rubber, etc.).

With continued reference to FIG. 3, if present, the aperture 216 (as shown as shown by broken lines in FIG. 3) may comprise a through aperture (e.g., a through opening, a through via, etc.) extending completely through the rigid body 208 (e.g., completely through each of the base structure 210 and the male connection structure 212), or may comprise a blind aperture (e.g., a blind opening, a blind via, a recess, a bore, etc.) extending partially through the rigid body 208 (e.g., completely through the base structure 210 and partially through the male connection structure 212, partially through the base structure 210 and completely through the male connection structure 212, etc.). The aperture 216 may exhibit any desired lateral cross-sectional shape including, but not limited to, a circular shape, a tetragonal shape (e.g., square, rectangular, trapezium, trapezoidal, parallelogram, etc.), a triangular shape, a semicircular shape, an ovular shape, an elliptical shape, or a combination thereof. The aperture 216 may exhibit substantially the same lateral dimensions (e.g., the same length and width, the same diameter, etc.) throughout the depth thereof, or the lateral dimensions of the aperture 216 may vary throughout the depth thereof (e.g., an upper portion of the aperture 216 may have at least one of a different length, a different width, and a different diameter than a lower portion of the aperture 216). In addition, as shown in FIG. 3, surfaces (e.g., inner sidewalls) of the rigid body 208 at least partially defining the aperture 216 may, optionally, exhibit one or more protrusions 224 (e.g., threads) for coupling with at least one structure and/or at least one device (e.g., an adjustment device, a sensor, etc.) to be at least partially contained within the aperture 216. In additional embodiments, the protrusions 224 may be omitted (e.g., absent) from surfaces (e.g., inner sidewalls) of the rigid body 208 at least partially defining the aperture 216.

If present, the adjustment device 220 may be configured and positioned to adjust (e.g., modify, change, etc.) at least one of a longitudinal position of the plug device 200 relative to the wear-resistant structure 120 (FIG. 2) and the shell 104 (FIG. 2) of the vessel 102 (FIG. 2), and an amount of force applied on each of the wear-resistant structure 120 and the shell 104 of the vessel 102 by the plug device 200. By way of non-limiting example, the adjustment device 220 may comprise a screw-type structure configured and positioned to engage (e.g., threadably engage) the protrusions 224 (e.g., threads) on the surfaces of the rigid body 208 at least partially defining the aperture 216, and configured to move longitudinally upward (e.g., toward the upper surface 204 of the plug device 200) and/or longitudinally downward (e.g., away from the upper surface 204 of the plug device 200) upon being rotated in one or more directions. For example, rotating the adjustment device 220 clockwise may move the adjustment device 220 longitudinally away from the upper surface 204 of the plug device 200, and rotating the adjustment device 220 counter-clockwise may move the adjustment device 220 longitudinally toward the upper surface 204 of the plug device 200, or vice versa. Moving the adjustment device 220 longitudinally away from the upper surface 204 of the plug device 200 and beyond the longitudinal boundaries of the aperture 216 may, for example, press the adjustment device 220 against the external surface 126 (FIG. 2) of the wear-resistant structure 120 (FIG. 2) to move at least the rigid body 208 of the plug device 200 longitudinally closer to the shell 104 of the vessel 102 and/or to increase the force applied to each of the external surface 126 of the wear-resistant structure 120 and the internal surface 118 (FIG. 2) of the shell 104 of the vessel 102 by the plug device 200. The longitudinal position of the adjustment device 220 may be adjusted prior to or after positioning the plug device 200 within the opening 122 (FIG. 2) in the shell 104 and longitudinally between the shell 104 and the wear-resistant structure 120.

The adjustment device 220, if present, may be formed of and include at least one rigid material, such as a rigid material suitable for use in a milling environment. By way of non-limiting example, the adjustment device 220 may be formed of and include one or more of a metal (e.g., tungsten, titanium, molybdenum, niobium, vanadium, hafnium, tantalum, chromium, zirconium, iron, ruthenium, osmium, cobalt, rhodium, iridium, nickel, palladium, platinum, copper, silver, gold, aluminum, etc.), a metal alloy (e.g., a cobalt-based alloy, an iron-based alloy, a nickel-based alloy, an iron- and nickel-based alloy, a cobalt- and nickel-based alloy, an iron- and cobalt-based alloy, a cobalt- and nickel- and iron-based alloy, an aluminum-based alloy, a copper-based alloy, a magnesium-based alloy, a titanium-based alloy, a steel, a low-carbon steel, a stainless steel, etc.), a metal-containing material (e.g., a metal nitride, a metal silicide, a metal carbide, a metal oxide), a ceramic material (e.g., carbides, nitrides, oxides, and/or borides, such as carbides and borides of at least one of tungsten, titanium, molybdenum, niobium, vanadium, hafnium, tantalum, chromium, zirconium, aluminum, and silicon), and a ceramic-metal composite material. The material composition of the adjustment device 220 may be substantially the same as the material composition of the rigid body 208, or may be different than the material composition of the rigid body 208. In some embodiments, the adjustment device 220 is formed of and includes a metal alloy (e.g., a steel alloy).

With continued reference to FIG. 3, if present, the sensor 218 may comprise an electronic device configured and positioned to monitor the status of (e.g., changes to) one or more components and/or one or more environmental conditions (e.g., conditions within and/or outside) of the vessel 102 (FIG. 1), and to communicate (e.g., transmit, relay, convey, etc.) information (e.g., data) related to the components and/or the environmental conditions to at least one other device (e.g., the receiving device 116) of the assembly 100 (FIG. 1). The sensor 218 may include at least one sensing module (e.g., a wear-detection module, such as an ultrasound-based wear-detection module; an acceleration sensing module; an audio sensing module; a temperature sensing module; a pressure sensing module; a velocity sensing module; a radiation sensing module; a moisture sensing module; a pH sensing module; etc.), and at least one output device (e.g., wireless transmitter, audio transducer, light-emitting diode, etc.). In some embodiments, at least a portion of the sensor 218 comprises a wireless transmitter, such as a radio frequency identification device (RFID). The wireless transmitter may be configured and operated to receive information associated with one or more other component(s) (e.g., sensing modules) of the sensor 218 and to transmit the information to the receiving device 116 of the assembly 100 (FIG. 1) by way of a detectable wireless signal (e.g., a detectable radio frequency (RF) signal). The wireless transmitter may, for example, receive an interrogation signal (e.g., an RF signal) from the receiving device 116 and may output another signal (e.g., another RF signal) corresponding to the status of one or more components and/or one or more environmental conditions of the vessel 102. The wireless transmitter (e.g., RFID) (if any) of one or more of the plug devices 200 of the assembly 100 may have a unique identification number permitting the wireless transmitter to be uniquely identified by the receiving device 116 relative to one or more other wireless transmitters (if any) of one or more other of the plug devices 200 of the assembly 100. The sensor 218 may also include other structures and/or devices, such as one or more power supplies (e.g., batteries), input devices (e.g., wireless receivers), memory devices, switches, resistors, capacitors, inductors, diodes, cases, etc.

The sensor 218, if present, may comprise a passive device configured to derive power for one or more components thereof from a device separate and distinct from the sensor 218, may comprise an active device including an integrated power supply (e.g., a power supply included as a component of the sensor 218) configured to power one or more components of the sensor 218, or may comprise a combination thereof. In some embodiments, the sensor 218 is a passive device that utilizes an interrogation signal from a receiving device 116 (FIG. 1) of the assembly 100 (FIG. 1) as a power source. For example, as the sensor 218 comes into proximity of the receiving device 116 (e.g., during rotation of the vessel 102 shown in FIG. 1) an electromagnetic field emitted by the receiving device 116 may be used to temporarily stimulate (e.g., activate, excite, etc.) the sensor 218 and detect changes (if any) to one or more components and/or to one or more environmental conditions of the vessel 102. The sensor 218 may then relay the information back to the receiving device 116 prior to powering down (e.g., losing operational charge), and/or may store the information for future transmission to the receiving device 116 prior to powering down. In additional embodiments, the sensor 218 is an active device that utilizes an integrated power supply (e.g., at least one battery) as a power source. The sensor 218 may use the power supply to stimulate (e.g., substantially continuously stimulate, periodically stimulate, etc.) one or more of the sensor modules and detect changes (if any) to one or more components and/or to one or more environmental conditions of the vessel 102. The sensor 218 may then relay (e.g., substantially continuously relay, periodically relay) the information back to the receiving device 116.

As shown in FIG. 3, the sensor 218, if present, may be substantially confined within boundaries (e.g., lateral boundaries and/or longitudinal boundaries) of the aperture 216 in the rigid body 208 of the plug device 200. For example, an upper surface 226 of the sensor 218 may be located within the aperture 216 (e.g., the upper surface 226 of the sensor 218 may be recessed relative to the upper surface 204 of the rigid body 208), or may be substantially coplanar with the upper surface 204 of the rigid body 208. Substantially confining the sensor 218 within the boundaries of the aperture 216 may, for example, decrease the risk of damage to the sensor 218 during subsequent removal of the plug device 200 and/or the wear-resistant structure 120 (FIG. 2) (e.g., during maintenance and/or replacement operations). In additional embodiments, one or more portion(s) of the sensor 218 may project beyond the boundaries (e.g., lateral boundaries and/or longitudinal boundaries) of the aperture 216.

The sensor 218, if present, may be configured and operated to sense and convey a single piece of information related to the use and operation of the vessel 102 (FIG. 1), or may be configured and operated to sense and convey multiple pieces of information related to the use and operation of the vessel 102. For example, the sensor 218 may be configured and operated to sense and convey information pertaining to one or more of the velocity of the vessel 102 (FIG. 1), the movement of materials (e.g., ore, charge, etc.) within the internal chamber 123 (FIG. 2) of the vessel 102, wear to one or more components (e.g., the wear-resistant structure 120 shown in FIG. 2) of and/or within the vessel 102, and the composition of the materials within the internal chamber 123 of the vessel 102. If the sensor 218 is configured and operated to sense and convey multiple pieces of information related to the use and operation of the vessel 102, the sensor 218 may utilize a single output device to convey the different pieces of information (e.g., a single wireless transmitter transmitting different data, a single audio transducer producing different sounds and/or different audio frequencies, a single LED producing different light intensities, etc.), or may utilize multiple output devices to convey the different pieces of information (e.g., multiple wireless transmitters transmitting different data, multiple audio transducers producing different sounds and/or different audio frequencies, multiple LEDs producing different colors of light and/or different light intensities, etc.).

With returned reference to FIG. 1, the vessel 102 may exhibit any desired distribution of the plug devices 200. Each of the plug devices 200 may be substantially the same (e.g., may each include substantially the same shapes, sizes, material compositions, components, arrangement of components, etc.) and may be uniformily (e.g., regularly, evenly, etc.) spaced relative to the other plug devices 200, or at least one of the plug devices 200 may be different (e.g., may include one or more of a different shape, a different size, a different material composition, different components, different arrangement of components, etc.) than at least one other of the plug devices 200 and/or may be non-uniformly (e.g., non-regularly, non-evenly, etc.) spaced relative to the other plug devices 200.

Therefore, with reference to FIGS. 1 through 3, and in accordance with embodiments of the disclosure, a method for plugging openings 122 in a shell 104 of a vessel 102 (e.g., mill) of an assembly 100 (e.g., milling assembly, grinding assembly, etc.) may include forming the plug devices 200, and positioning the plug devices 200 within the openings 122 in the shell 104 and adjacent the internal surface 118 of the shell 104. The wear-resistant structure 120 may then be positioned and attached to a shell 104 of the vessel 102 using the retention devices 114, and may press against (e.g., directly contact and press against) and retain the plug devices 200 in position. As the vessel 102 is used (e.g., axially rotated) to process (e.g., grind, pulverize, crush, etc.) one or more structures (e.g., ore structures) in the internal chamber 123 thereof, the plug devices 200 may substantially limit or even prevent loss of one or more materials (e.g., fluids, solid particles, etc.) through the openings 122. The plug devices 200 may also monitor and relay (e.g., from the output device of the sensor 218 to the receiving device 116 of the assembly 100) information (e.g., vessel rotation speed, vessel wear, material movement, material composition, etc.) associated with the processing of the one or more structures. The information may then be acted upon (e.g., further transmitted, compiled, displayed, analyzed, stored, etc.), as desired.

The assemblies, devices, and methods of the disclosure may provide enhanced efficiency, reduced costs, and improved safety as compared to the assemblies, devices, and methods conventionally associated with processing (e.g., grinding, pulverizing, crushing, etc.) a mined material (e.g., ore). For example, the plug devices (e.g., the plug devices 200) of the disclosure provide a simple means of plugging (e.g., sealing) openings (e.g., the openings 122) in a shell (e.g., the shell 104) of a vessel (e.g., the vessel 102), and may exhibit improved durability and enhanced removal ease as compared to conventional plug devices. The plug devices of the disclosure may also facilitate more efficient removal of structures (e.g., the wear-resistant structures 120) lining the shell of the vessel as compared to conventional plug devices, reducing maintenance and/or replacement downtime and significantly reducing costs. The plug devices of the disclosure are easy to produce, handle, position, and secure to components (e.g., the shell 104 of the vessel 102, the wear-resistant structure 120, etc.) of an assembly (e.g., the assembly 100), and may be tailored to particular needs of the assembly. Moreover, the plug devices of the disclosure may be configured and operated to provide other useful information (e.g., rotational velocity of the vessel 102, wear to components of and/or within the vessel 102, movement of materials within the vessel 102, etc.) associated with processing a mined material.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. An assembly, comprising:

a vessel comprising a shell exhibiting at least one opening extending therethrough;

a structure covering an internal surface of the shell; and at least one plug device contacting the shell and the structure, and comprising:

a rigid body comprising:

a male connection structure longitudinally extending into the at least one opening and exhibiting an aperture longitudinally extending therethrough, the male connection structure comprising:

inner sidewalls defining lateral boundaries of the aperture;

a threaded structure located within the aperture and laterally protruding from the inner sidewalls; and an upper surface completely contained within the at least one opening and recessed relative to an external surface of the shell; and a base structure extending outwardly beyond a lateral periphery of the male connection structure and positioned longitudinally between the structure and the shell, the base structure coupled to the male connection structure through a weld joint, a braze joint, or a solder joint; and an adjustment device located within the aperture of the male connection structure of the rigid body and physically contacting the thread structure of the male connection structure and a surface of the structure.

2. The assembly of claim 1, wherein the male connection structure only fills a portion of the at least one opening.

3. The assembly of claim 1, wherein at least one surface of the base structure directly physically contacts at least one of the internal surface of the shell and an external surface of the structure.

4. The assembly of claim 1, wherein the at least one plug device further comprises a deformable structure longitudinally between the base structure and the shell and laterally surrounding the male connection structure.

5. The assembly of claim 1, wherein the at least one plug device further comprises a sensor substantially confined within lateral boundaries and longitudinal boundaries of the aperture and comprising at least one sensor module and at least one output device.

6. The assembly of claim 5, wherein the sensor comprises at least one of a wear detection module, a pressure sensing module, a temperature sensing module, an audio sensing module, a velocity sensing module, an acceleration sensing module, a radiation sensing module, a moisture sensing module, and a pH sensing module.

7. The assembly of claim 1, wherein the at least one plug device comprises a plurality of plug devices, at least one of the plurality of plug devices exhibiting a different structural configuration than at least one other of the plurality of plug devices.

8. A plug device for a milling application, comprising:
- a rigid body comprising:
  - a base structure; and
  - a male connection structure longitudinally protruding from the base structure and exhibiting an aperture longitudinally extending therethrough, the base structure extending outwardly beyond a lateral periphery of the male connection structure;
- a thread structure located within the aperture of the male connection structure and laterally protruding from surfaces of the male connection structure; and
- an adjustment device within the aperture and engaging the thread structure, the adjustment device configured to move longitudinally upward within the aperture upon being rotated in a first direction and to move longitudinally downward within the aperture upon being rotated in a second direction.

9. The plug device of claim 8, wherein the male connection structure and the base structure each independently comprise at least one metal material, and wherein the male connection structure is coupled to the base structure through a weld joint, a braze joint, or a solder joint.

10. The plug device of claim 8, further comprising at least one seal structure on a surface of the base structure proximate the male connection structure, the at least one seal structure surrounding a sidewall of the male connection structure.

11. The plug device of claim 8, further comprising a sensor substantially contained within the aperture and comprising at least one sensor module and at least one output device.

12. The plug device of claim 11, wherein the sensor comprises a passive device configured to derive power for one or more components thereof from another device separate and distinct from the sensor.

13. The plug device of claim 11, wherein the sensor further comprises an integrated power supply configured to power one or more other components of the sensor.

14. The plug device of claim 11, wherein the at least one output device comprises at least one wireless output device.

15. A method of plugging a component of an assembly, comprising:
- delivering a plug device into an opening extending through a shell of a vessel, the plug device comprising:
  - a rigid body comprising:
    - a male connection structure extending partially through the opening from an internal surface of the shell and exhibiting an aperture longitudinally extending therethrough, the male connection structure comprising:
      - inner sidewalls defining lateral boundaries of the aperture;
      - a threaded structure located within the aperture and laterally protruding from the inner sidewalls; and
      - an upper surface completely contained within the opening and recessed relative to an external surface of the shell; and
    - a base structure longitudinally adjacent the internal surface of the shell and extending outwardly beyond a lateral periphery of the male connection structure, the base structure coupled to the male connection structure through a weld joint, a braze joint, or a solder joint; and
  - an adjustment device located within the aperture of the male connection structure of the rigid body and engaging the thread structure of the male connection structure;
- covering the internal surface of the shell with a structure, an external surface of the structure physically contacting at least one surface of the plug device; and
- coupling the structure to the shell using at least one retention device extending through the structure and the shell.

16. The method of claim 15, wherein the plug device further comprises an adjustment device partially disposed within an aperture extending through the male connection structure of the rigid body, and wherein covering the internal surface of the shell with a structure comprises physically contacting a surface of the adjustment device with the external surface of the structure.

17. The assembly of claim 1, wherein:
- the structure comprises a wear-resistant plate; and
- a lower surface of the at least one plug device opposite the upper surface of the at least one plug device directly contacts and is completely covered by an external surface of the wear-resistant plate.

* * * * *